United States Patent [19]

Pawlowski

[11] 4,239,125

[45] Dec. 16, 1980

[54] CUP DISPENSING APPARATUS

[75] Inventor: Thomas D. Pawlowski, Neenah, Wis.

[73] Assignee: American Can Company, Greenwich, Conn.

[21] Appl. No.: 3,087

[22] Filed: Jan. 12, 1979

[51] Int. Cl.[3] ..... A47F 1/06

[52] U.S. Cl. ..... 221/65; 221/305; 221/307

[58] Field of Search ..... 221/65, 267, 303–310; 229/17 R, 17 B, 37 R, 41 R, 41 B

[56] References Cited

U.S. PATENT DOCUMENTS

| | | | |
|---|---|---|---|
| 2,468,497 | 4/1949 | Johnson et al. | 221/65 X |
| 2,991,910 | 7/1961 | Coe | 221/305 |
| 3,006,503 | 10/1961 | O'Neil | 221/307 |
| 3,165,234 | 1/1965 | Conklin et al. | 221/302 |
| 3,243,082 | 3/1966 | Thompson | 221/302 |
| 3,261,500 | 7/1966 | McGlynn | 221/63 |
| 3,288,329 | 11/1966 | Ketchem | 221/155 |
| 3,365,100 | 1/1968 | Piazze | 221/302 |
| 3,411,665 | 11/1968 | Blum | 221/282 |
| 3,669,307 | 6/1972 | Pfund et al. | 221/310 X |
| 3,820,686 | 6/1974 | Tyrseck | 221/305 |
| 3,921,897 | 11/1975 | Noyes et al. | 229/41 B X |

*Primary Examiner*—F. J. Bartuska

*Attorney, Agent, or Firm*—Robert P. Auber; George P. Ziehmer; Harry W. Hargis, III

[57] ABSTRACT

A cup dispensing package comprises an axially collapsible cylindrical sleeve for storing a stack of nested, disposable cups. The sleeve comprises at least a pair of bands at its opposite end portions, axially extending, uniformly circumferentially spaced slits between the bands that define axially extending strips provided with circumferential cut scores, and a detent on one of the bands frictionally engaging the rim of a partially extending cup to retain the latter prior to its forcible removal. The strips fold radially outwardly then downwardly about their cut scores and transverse sections thereof in response to axially applied compressive force on the sleeve, by the user, as the cups are removed, thereby presenting a fully extended frictionally retained cup for dispensing until such time the cup supply is exhausted.

31 Claims, 9 Drawing Figures

FIG. 6
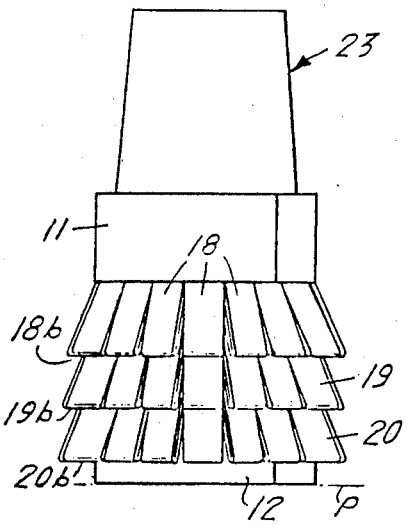
FIG. 7
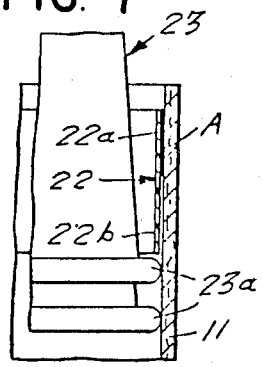
FIG. 8
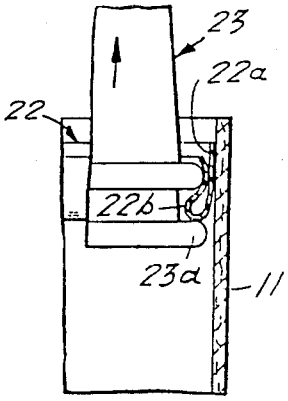
FIG. 9
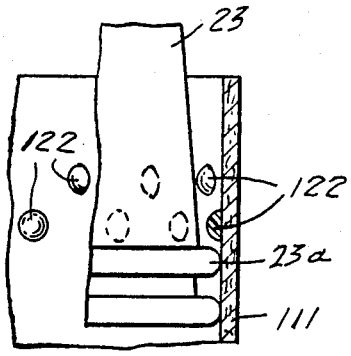
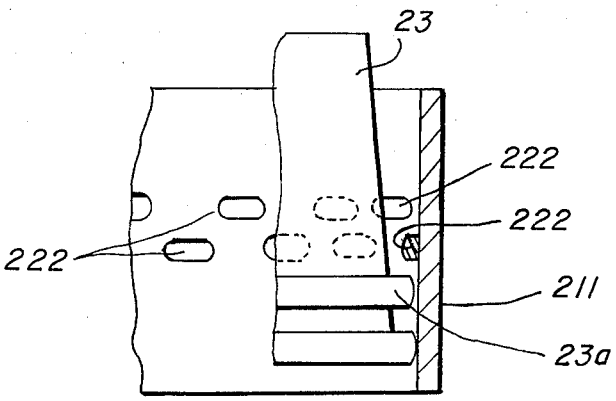
FIG. 10

CUP DISPENSING APPARATUS

BACKGROUND OF THE INVENTION

This invention relates to packaging, and more particularly to packaging structure for a stack of nested cups that serves also as dispensing means for the same.

Molded plastic cup dispensers are well known in the art. Stacks of nested cups are loaded into such dispensers, and are presented at an end thereof for dispensing one at a time. Such dispensers require some form of permanent mounting bracket means utilizing, for example, screws, cement, tape, or the like. A dispenser of the molded plastic type also represents an initial investment, and is usually of a construction limiting the user to a particular cup size.

Efforts directed to eliminating need for permanently mounted dispensers in the interest of economy and versatility have resulted in packaging stacks of nested cups in disposable sleeves, some adapted for mounting, and from which the cups may be dispensed individually.

The following is a listing of U.S. Patents believed material to the examination of this application, together with a concise explanation of the relevance of each:

No. 3,006,503 discloses a disposable dispenser for nested cups 13 including a cup container 10 provided with an external resililent member 25 having a tapered cup retaining rim 28 through which the cups may be dispensed.

No. 3,165,234 discloses a disposable sleeve 14 for holding and dispensing cups C from a nested stack. Circumferential beads 24 are molded adjacent the open end of the sleeve frictionally to retain the cups while accommodating forcible dispensing thereof.

No. 3,243,082 discloses a bag 1 for containing a stack of nested cups 7. The bottom cup 25 of the stack is frictionally retained by a resilient band 5 on the bag while affording forcible removal of a lowermost cup.

No. 3,261,500 discloses a sleeve-type dispenser 10 for containing a stack S of nested cups P. Projections 21 frictionally retain the lowermost cup of the stack while accommodating its removal.

No. 3,288,329 discloses a sleeve-shaped dispenser for a stack of nested cups 34. The lowermost cup is frictionally retained within a starburst opening provided in a lower insert 28, and accommodating one-at-a-time removal of the cups.

No. 3,365,100 discloses a packaging and dispensing sleeve 56 for containing a stack of nested cups 55. The lowermost cup is retained by a lesser diameter, shrunken portion 61 of the sleeve past which a cup is forcibly removable.

No. 3,411,665 discloses a packaging and dispensing sleeve 22 for a stack of nested cups 12. A circumferential bead 44 retains the cups for forcible removal therepast.

It is a general objective of the invention to provide an improved disposable dispenser for a stack of nested paper cups and the like.

It is a further objective of the invention to provide an improved packaging and dispensing sleeve for a stack of nested cups capable of controlled collapsibility upon removal of the cups.

It is a still further objective of the invention to provide an improved cup packaging sleeve which may serve as a disposable dispenser itself, or may be used as a cartridge to aid in insertion of the cups in a permanent dispenser.

SUMMARY OF THE INVENTION

In achievement of the foregoing as well as other objectives, the invention contemplates cup dispensing apparatus comprising: a sleeve for containing a stack of nested cups, said sleeve including a plurality of generally axially extending, circumferentially spaced wall-defining strips of uniform length; means defining a fold line disposed in the region of at least one end of each said strip and circumferentially aligned, transversely extending cut scores on said strips intermediate ends thereof; and detent means disposed toward one end of and adherent to the interior surface of said sleeve for engagement by the rim of a cup to retain a stack of nested cups in said sleeve, said sleeve being collapsible by folding of said strips about said fold lines and said cut scores upon urging ends of said sleeve toward one another, as cups are removed from a stack, thereby to maintain engagement of said detent means with a cup rim.

The manner in which the foregoing as well as other objectives and advantages of the invention may best be achieved will be more fully understood from a consideration of the following description, taken in light of the accompanying drawing.

BRIEF DESCRIPTION OF THE DRAWINGS

FIGS. 4, 5, and 6 are sequential operational views similar to FIG. 3, and illustrating collapsibility of the sleeve;

FIG. 7 is an enlarged sectional view of the sleeve seen in FIG. 3, taken in the plane of line 7—7, and looking in the direction of arrows applied thereto;

FIG. 8 is a view similar to FIG. 7, and illustrates an operational feature of a portion of the apparatus embodying the invention;

FIG. 9 is an enlarged sectional view similar to FIG. 7, and illustrates an alternative embodiment contemplated by the invention; and FIG. 10 is a sectional view similar to FIG. 9, and illustrates a further alternative embodiment contemplated by the invention.

DESCRIPTION OF THE SEVERAL EMBODIMENTS

Figure 1:
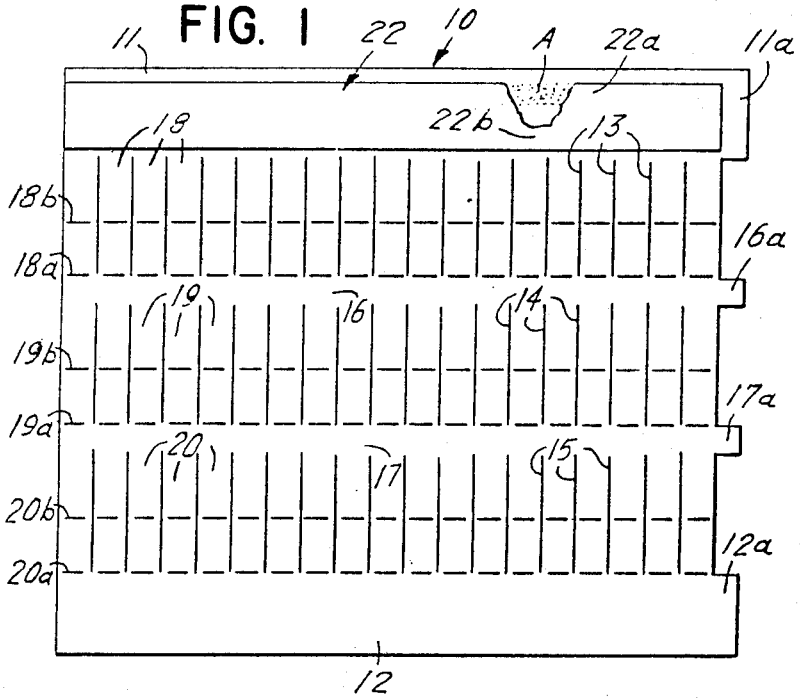
FIG. 1 is a plan view of a paperboard blank from which there is fabricated a disposable cup dispensing sleeve embodying the invention.

With more detailed reference to the drawing, there is seen in FIG. 1 a paperboard blank 10 of generally rectangular configuration including upper and lower bands 11 and 12 of substantially equal width. Three sets of mutually aligned slits 13, 14, and 15 extend in a direction normal to bands 11 and 12. Sets of slits 13 and 15 terminate on the one hand at bands 11 and 12, respectively, and at bands 16 and 17, on the other hand. Set of slits 14 extends between bands 16 and 17. The sets of slits 13, 14, and 15 are equally laterally spaced and cooperate to define sets of similarly extending strips 18, 19, and 20. Bands 11, 12, 16 and 17 terminate in respective tabs **11*a*, 12*a*, 16*a*, and 17*a* at the right hand ends thereof. A band 22 comprising a film of plastic material, such as, for example polyethylene, is adhered by a suitable adhesive A, in the region of its upper half 22***a*, to upper band 11. It will be understood, of course, that band 22 may, alternatively, be adherent along a portion thereof at least intermediate its edge portions, or along an edge portion thereof and preferably the edge more remote from the opposite end of the sleeve than the free edge of band 22. Further to the construction of blank 10, which is of a flexible and resilient material, such as, for example, 0.010 inch thick paperboard, the lower ends of strips 18, 19, and 20 are provided with single transverse cut scores 18*a*, 19*a* and 20*a*, respectively, and intermediate portions the same strips are provided with single transverse cut scores 18*b*, 19*b*, and 20*b*, respectively. For reasons to be more fully explained in what follows, cuts 18*b*, 19*b*, and 20*b* are disposed in their respective strips slightly below center, as respects their respective lengths (i.e. closer to cut scores 18*a*, 19*a*, 20*a* than to the other end of their respective strips).

Figure 2:
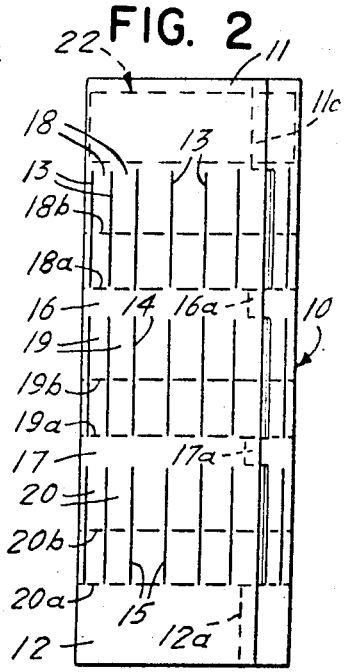
FIG. 2 is an elevational view of a sleeve fabricated from the blank shown in FIG. 1.

In especial accordance with the invention, and with reference to FIG. 2, a suitable adhesive is applied to the underside of tabs 11*a*, 12*a*, 16*a* and 17*a*, as viewed in FIG. 1, and blank 10 is curled by known suitable means into a cylindrical configuration 10*a* in which the aforesaid tabs become adherent to the inner surfaces of the left hand ends of bands 11, 12, 16, and 17, respectively. In such cylindrical configuration, blank 10 is transformed into a generally cylindrical sleeve 10*a* including a plurality of axially extending, uniformly spaced wall-defining strips of uniform length which in the preferred embodiment comprise the three sets 18, 19, and 20.

Figure 3:
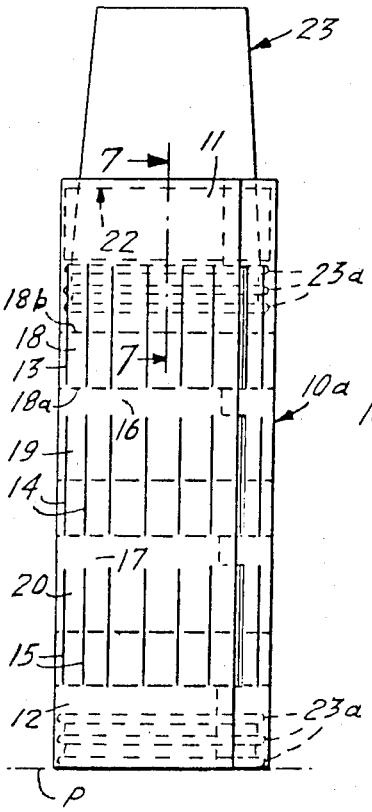
FIG. 3 is an elevational view similar to FIG. 2, and with a stack of nested cups packaged in the sleeve.

Also in forming sleeve 10*a*, and with reference to FIG. 3, band 22 becomes a circumferentially extending detent means for a stack of nested cups 23, which may be of paper or plastic and are of generally frusto-conical shape, and which stack has been inserted through the lower end of sleeve 10*a* so that, as also seen to advantage in FIG. 7, the rim 23*a* of the uppermost or end cup is disposed adjacent the lower edge of band 22 and the main body portion of the same cup projects outwardly of the sleeve. As the first cup 23 is removed, and with reference to FIG. 8, the free, lower portion 22*b* of band 22 is folded upwardly. Band 22, in either its original or folded position, will afford a frictional force sufficient to prevent inadvertant removal of a projecting cup 23, which frictional force will accommodate sliding removal of a cup from the sleeve. In order to remove a cup 23, a user need only grasp the dispenser sleeve 10*a* by one hand, while grasping and pulling the projecting end cup by the other hand. It is further to be understood that to overcome need for using both hands, the illustrated lower end of sleeve 10*a* may be adhered of fastened to support plane P by some known means, not shown.

Figure 4:
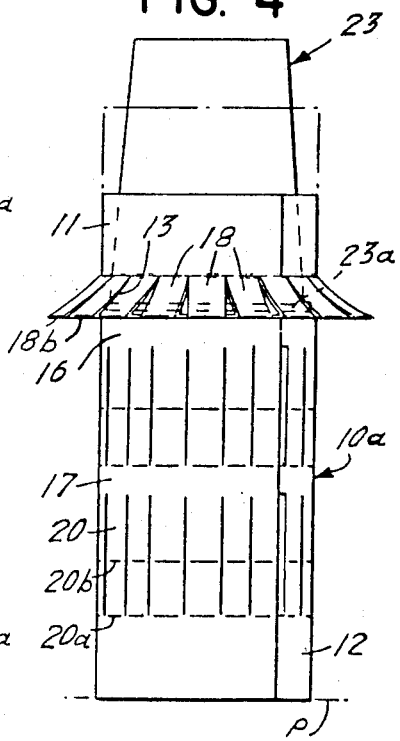
Figure 5:
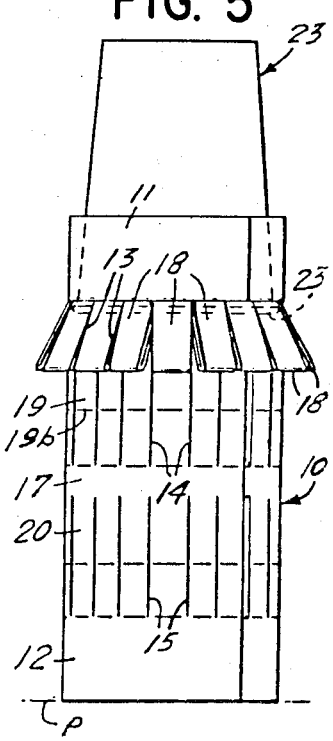

As the cups 23 are used, the height of the stack will diminish, for example, to a quantity as is seen in FIG. 4. For such a quantity as shown, the upper end of sleeve 10*a* (broken line showing) will extend over a major portion of the projecting cup, making it somewhat difficult to grasp. To overcome this difficulty the user manually forces the upper band 11 downwardly to the full line showing thereof. This movement advantageously is achieved by the controlled folding of strips 18, outwardly of the sleeve as is afforded by suitably located cut scores 18*a* and 18*b*, taken with flexibility and resilience of the paperboard material of the strips themselves. It will be appreciated that the invention contemplates other thicknesses of paperboard, as well as plastic materials such as, for example, similarly formed, foldable sheets of polyethylene, foamed polystrene, and the like. The downward pivotation about cuts 18*a* of the lower portions of strips 18 (i.e. the portions between cut scores 18*a*, and 18*b*) occurs because this is the shorter section of the strip, the upper sections being longer and compensating therefor by bowing slightly inwardly as seen in FIG. 4, as the same upper sections fold transversely of their upper end portions. Continued downward displacement of band 11 will occur until the folded portion 22*b* of band 22 engages the rim 23*a* of the end cup, which displacement is accompanied by a snapping, overcenter movement of the folded strips 18 wherein the bowed longer portion thereof straightens out and urges the shorter portions toward the sleeve, thereby establishing and maintaining the shortened or partially collapsed mode of sleeve 10*a*. After additional quantities of cups are removed, reducing the height of the stack, the sections are successively collapsible (i.e. the center section followed by the lower section) until the mode seen in FIG. 6 is attained, from which all remaining cups may be removed.

An alternative embodiment of the invention is seen in FIG. 9, where in detent means for restraining the endmost cup 23 of a stack comprises a pair of rows of beads 122 of hot melt adhesive adherent to the inner surface of band 111 and projecting inwardly. The beads 122 are so disposed that the arcuate surface portion of each lower bead 122 engages the rim 23*a* of the endmost cup 23 to retain the latter and the remainder of the stack in the sleeve. Each upper bead 122 serves as an additional frictional retention means and both rows are engageable by rim 23*a* of a cup as it is removed.

Upon removal of the end cup 23, as is accommodated by the rows of beads 122, the lower row of beads 122 engages the rim 23*a* of the next cup in the stack for retention thereof. By virtue of the arcuate shape of the surface of each bead 122 essentially point contact is maintained between the rim 23*a* and the surface of each bead. This mode of contact ensures improved cup retention coupled with ease of cup release.

Hot melt adhesives for use in the formation of beads 122 are well known in the art of packaging. Such adhesives comprise themoplastic polymer based compounds that the capable of being applied to surfaces of sleeve 111 in a melted state following which they quickly cool and set.

A preferred configuration comprises a first row of 3/16 inch diameter beads spaced circumferentially about $\frac{3}{4}$ inch apart, and a similar second row axially spaced about $\frac{3}{8}$ inch therefrom, and circumferentially offset by about $\frac{3}{8}$ inch as respects the first row so that the beads of one row are opposite the interstices of the beads in the other row. While the beads are illustrated in FIG. 9 as circular, it is to be understood from FIG. 10 that the beads may be applied in elongate strips 222 of such configurations and dimensions as both to accommodate forcible removal of cups 23 singly from a sleeve 211, and to afford retention of a cup stack.

While in any of the embodiments it is contemplated that the collapsible dispensing sleeve be formed first, followed by insertion of a stack of nested cups, it will be understood that several sleeve blanks may be formed integrally, wrapped about a correspondingly dimensioned stack of cups, and the wrapped blank then severed to form individual sleeves containing individual stacks of nested cups.

While the sleeve 10*a* has been illustrated in a position presenting the cups bottom-side-up, it will be appreciated that the hereinabove mentioned contemplated holding or mounting means may hold the sleeve in an inverted position as respects the illustrated position so that the cups will be top-side-up. The invention contemplates further that sleeve 10*a* and its contents may be loaded as a unit in an existing permanent dispenser, in effect affording cartridge-type loading. Alternatively, the cups could be removed from the sleeve and loaded directly into the dispenser. In any event, the sleeve may bear a desired decorative pattern, consistent with, for example, a pattern that might be printed on the cups, which pattern would be visible through walls of the dispenser or through transparent film wrap for the sleeve as marketed for purchase by a user.

While several embodiments of the invention have been disclosed, it will be appreciated that it is susceptible of such other modifications as may fall within the scope of the appended claims.

I claim:

1. Cup dispensing apparatus comprising: a sleeve of flexible and resilient material for containing a stack of nested cups, said sleeve including at least one set of a plurality of generally axially extending circumferentially spaced wall-defining strips of uniform length; means defining a fold line disposed in the region of at least one end of each said strip and circumferentially aligned, transversely extending cut score lines on said strips intermediate ends thereof; and detent means disposed toward one end of and adherent to the interior surface of said sleeve for engagement by the rim of a cup to retain a stack of nested cups in said sleeve, said sleeve being collapsible by folding of said strips about said fold lines and said score lines outwardly of said sleeve upon urging ends of said sleeve relatively toward one another, in correspondence with removal of cups from a stack contained within said sleeve, thereby to maintain engagement of said detent means with a cup rim.

2. Apparatus according to claim 1, and characterized in that said detent means comprises a band of plastic sheet material adherent to the interior end portion of said sleeve.

3. Apparatus according to claim 2, and characterized further in that said band is adherent along a portion thereof at least intermediate its edge portions.

4. Apparatus according to claim 1, and characterized in that said detent means comprises a circumferentially extending band of plastic sheet material having a pair of edge portions, said band being adherent along at least one edge portion thereof to the interior end portion of said sleeve, the other edge portion being non-adherent.

5. Apparatus according to claim 4, and characterized further in that the adherent edge portion of said band is more remote from the opposite end of said sleeve than is the non-adherent edge of said band.

6. Apparatus according to claim 1 and characterized in that said detent means comprises beads of hot melt adhesive on the interior surface of said sleeve and circumferentially mutually spaced in at least one substantially circular row.

7. Apparatus according to claim 6, and characterized further in that said beads are substantially circular.

8. Apparatus according to claim 6, and characterized in that said beads are elongate.

9. Apparatus according to claim 6 or 7, and characterized in that said beads are arranged in at least two rows disposed in closely axially spaced relationship to one another, the beads of each row being uniformly mutually spaced, and the beads of one row further being disposed opposite the interstices of the beads of the other row.

10. Cup dispensing apparatus comprising: a sleeve of flexible and resilient material for containing a stack of nested cups, said sleeve including at least one set of a plurality of generally axially entending circumferentially spaced wall-defining strips of uniform length; circumferentially aligned means intermediate ends of said strips defining weakened foldable regions; and detent means disposed toward one end of and adherent to the interior surface of said sleeve for engagement by the rim of a cup to retain said stack or nested cups in said sleeve, said sleeve being collapsible by folding of said strips about said weakened foldable regions and about ends thereof outwardly of said sleeve upon forcibly urging ends of said sleeve relatively toward one another, in correspondence with removal of cups from a stack contained within said sleeve, thereby to maintain engagement of said detent means with a cup rim.

11. Apparatus according to claim 10, and characterized in that said plurality of wall-defining strips are disposed in at least a pair of axially spaced sets, the construction and arrangement being such that urging said ends relatively toward one another effects collapse initially of the strips adjacent the end of said sleeve from which cups are removed, followed by collapse of the next set of strips adjacent the recited first set.

12. Apparatus according to claim 10, and characterized in that, for each said strip, said means defining a weakened foldable region comprises a cut score line disposed closer to the end of said strip more remote from said detent means than the opposite end, and further by the inclusion of means defining a fold line on each said strip in the region of the recited more remote end thereof.

13. Apparatus according to claim 10, 11, or 12 and characterized in that said detent means comprises a band of plastic sheet material adherent to the interior end portion of said sleeve.

14. Apparatus according to claim 13, and characterized further in that said band is adherent along a portion thereof at least intermediate its edge portions.

15. Apparatus according to claim 10, 11 or 12, and characterized in that said detent means comprises a circumferentially extending band of plastic sheet material having a pair of edge portions, said band being adherent along at least one edge portion of said sleeve, the other edge portion being non-adherent.

16. Apparatus according to claim 15, and characterized further in that the adherent edge portion of said band is more remote from the opposite end of said sleeve than is the non-adherent edge of said band.

17. Apparatus according to claim 10, 11 or 12, and characterized in that said detent means comprises beads of hot melt adhesive on the interior surface of said sleeve and circumferentially spaced in at least one substantially circular row.

18. Apparatus according to claim 17, and characterized further in that said beads are substantially circular.

19. Apparatus according to claim 17, and characterized in that said beads are elongate.

20. Apparatus according to claim 18, and characterized in that said beads are arranged in at least two rows disposed in closely axially spaced relationship to one another, the beads of each row being uniformly mutually spaced, and the beads of one row further being disposed opposite the interstices of the beads of the other row.

21. Cup dispensing apparatus comprising: a sleeve of flexible and resilient material for containing a stack of nested cups, said sleeve including at least one set of a plurality of generally axially extending circumferentially spaced wall-defining strips of uniform length; means defining a fold line disposed in the region of at least one end of each said strip and circumferentially aligned, transversely extending cut score lines on said strips intermediate ends thereof; and detent means disposed toward one end of and adherent to the interior surface of said sleeve for engagement by the rim of a cup to retain a stack of nested cups in said sleeve, said detent means comprising beads of hot melt adhesive on the interior surface of said sleeve and circumferentially mutually spaced in at least one substantially circular row, said sleeve being collapsible by folding of said strips about said fold lines and said score lines upon urging ends of said sleeve relatively toward one another, as cups are removed from a stack, thereby to maintain engagement of said detent means with a cup rim.

22. Apparatus of claim 21, wherein said beads are substantially circular.

23. Apparatus of claim 21, wherein said beads are elongate.

24. Apparatus of claim 21 or 22, wherein said beads are arranged in at least two rows disposed in closely axially spaced relationship to one another, the beads of each row being uniformly mutually spaced, and the beads of one row further being disposed opposite the interstices of the beads of the other row.

25. Cup dispensing apparatus comprising: a sleeve of flexible and resilient material for containing a stack of nested cups, said sleeve including at least one set of a plurality of generally axially extending circumferentially spaced wall defining strips of uniform length; circumferentially aligned means intermediate ends of said strips defining weakened foldable regions; and detent means comprising beads of hot melt adhesive disposed toward one end of and adherent to the inner surface of said sleeve, said beads being circumferentially spaced about the sleeve in at least one substantially circular row for engagement by the rim of a cup to retain said stack of nested cups in said sleeve, said sleeve being collapsible by folding of said strips about said weakened foldable regions and about ends thereof upon forcibly urging ends of said sleeve relatively toward one another as cups are removed past said detent means, from said stack, thereby to maintain engagement of said detent means with a cup rim.

26. Apparatus of claim 25, wherein said plurality of wall-defining strips are disposed in at least a pair of axially spaced sets, the construction and arrangement being such that urging said ends relatively toward one another effects collapse initially of strips adjacent the end of said sleeve from which cups are removed, followed by collapse of the next set of strips adjacent the recited first strip.

27. Apparatus of claim 25, wherein, for each said strip, said means defining a weakened foldable region comprises a cut score line disposed closer to the end of said strip more remote from said detent means than the opposite end, and further by the inclusion of means defining a fold line on each said strip in the region of the recited more remote end thereof.

28. Apparatus of claim 25, 26 or 27, wherein said beads are substantially circular.

29. Apparatus of claim 25, 26 or 27, wherein said beads are elongate.

30. Apparatus of claim 28, wherein said beads are arranged in at least two rows disposed in closely axially spaced relationship to one another, the beads of each row being uniformly mutually spaced, and the beads of one row further being disposed opposite the interstices of the beads of the other row.

31. Apparatus of claim 21 or 25, wherein said strips are foldable outwardly of said sleeve.

* * * * *